United States Patent [19]

Chen

[11] Patent Number: 4,669,155

[45] Date of Patent: Jun. 2, 1987

[54] BELT BUCKLE

[76] Inventor: Kuo-Jen Chen, No. 8, Lane 15, Chung Ching N. Rd., Sec. 1, Taipei City 100, Taiwan

[21] Appl. No.: 806,992

[22] Filed: Dec. 9, 1985

[51] Int. Cl.[4] ..... A44B 11/12

[52] U.S. Cl. ..... 24/170; 24/171; 24/191

[58] Field of Search ..... 24/170, 171, 191, 194, 24/309, 311, 316, 265 WS

[56] References Cited

U.S. PATENT DOCUMENTS

| | | | |
|---|---|---|---|
| 3,884 | 1/1845 | Beverly | 24/170 |
| 2,845,674 | 8/1958 | Pearson | 24/170 |
| 3,478,537 | 11/1969 | Golberine et al. | 24/265 WS |
| 3,979,800 | 9/1976 | Masuda | 24/171 |
| 4,419,792 | 12/1983 | Kohli | 24/170 |

FOREIGN PATENT DOCUMENTS

| | | | |
|---|---|---|---|
| 1204470 | 1/1960 | France | 24/170 |

*Primary Examiner*—Victor N. Sakran
*Attorney, Agent, or Firm*—Armstrong, Nikaido, Marmelstein & Kubovcik

[57] ABSTRACT

An improved belt buckle characterized by comprising a buckle body, a belt catch holder, a belt catch, a fastening plate, a spring plate and a serrate plate wherein said belt catch being fitted in a recess of said belt catch holder and joined together with said buckle body and belt catch holder by means of knuckles formed thereon and a pin so as to allow the belt to pass the slot in the buckle body freely and to catch the same as it retreats; said fastening plate being fitted in the space of said belt catch holder and joined together with said belt catch holder by means of knuckle and pin so as to fasten the belt end; said spring plate being fixed to the fastening plate and engaging one ratchet corner of said belt catch so that the other ratchet corner can move retractably; said serrate plate being mounted on the reverse of the belt for said belt catch to catch adjustably.

1 Claim, 7 Drawing Figures

BELT BUCKLE

BACKGROUND AND SUMMARY OF THE INVENTION

There are many types of belt buckles available now but the most common types are: one with a ratchet to hold the belt and another with a stud to insert in a series of equidistant holes in the belt. As shown in FIG. 1, the ratchet 1 is fixed on the knuckle pin 3 which is fitted in the knuckles on the side wall of the buckle body 2. A torsion spring 4 is provided to push the ratchet so that it can move retractably. Two stop pieces 7 extending from the knuckles of the belt end fastener 5 are provided to prevent the ratchet from further turning. So the belt 6 can not retreat after being inserted in the buckle body 2 and the end of the belt is fastened. But a belt made of leather is apt to slip and the ratchet will scrape, and cause damage to the belt. So failure to fasten the belt firmly will occur after it is used for a certain period of time.

As shown in FIG. 2, the buckle body 2 has a stud 1 and the belt has a series of holes 3 equidistant from each other. The belt is fastened by inserting the stud 1 in one of the holes 3. But holes in the belt often impair the esthetic sense. Moreover, the hole will deform and even break after use. Since the holes are in fixed position (distance), it can not be adjusted freely to meet the needs of different people in different cases such as fat and thin persons and before and after meals.

To eliminate the disadvantages of conventional belt buckles, this invention was developed. So the main object of this invention is to provide an improved belt buckle comprising a swinging, retractable belt catch and a serrate plate to fasten the end of belt firmly.

Another object of this invention is to provide an improved belt buckle with which the tightness can be adjusted freely to meet the needs of different people in different cases without fear of loosening or slipping.

Still another object of this invention is to provide an improved belt buckle which will not scrape, damage, and imperil the esthetic sense of the belt.

DETAILED DESCRIPTION

Figure 1:
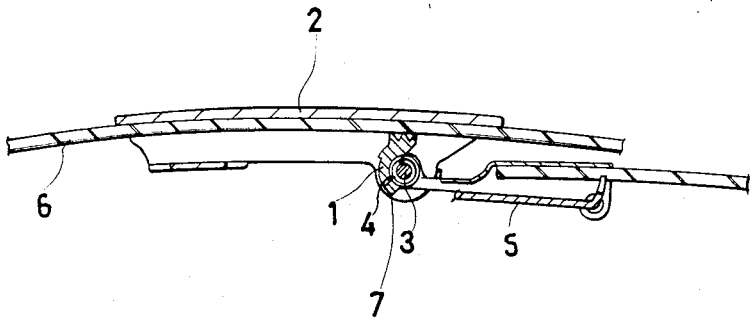
Fig. 1 PRIOR ART
FIG. 1 is schematic view of the conventional ratchet-type belt buckle.
Figure 2:
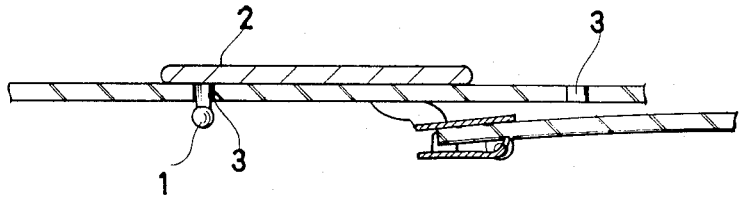
Fig. 2 PRIOR ART
FIG. 2 is a schematic view of the conventional stud-type belt buckle.
Figure 3:
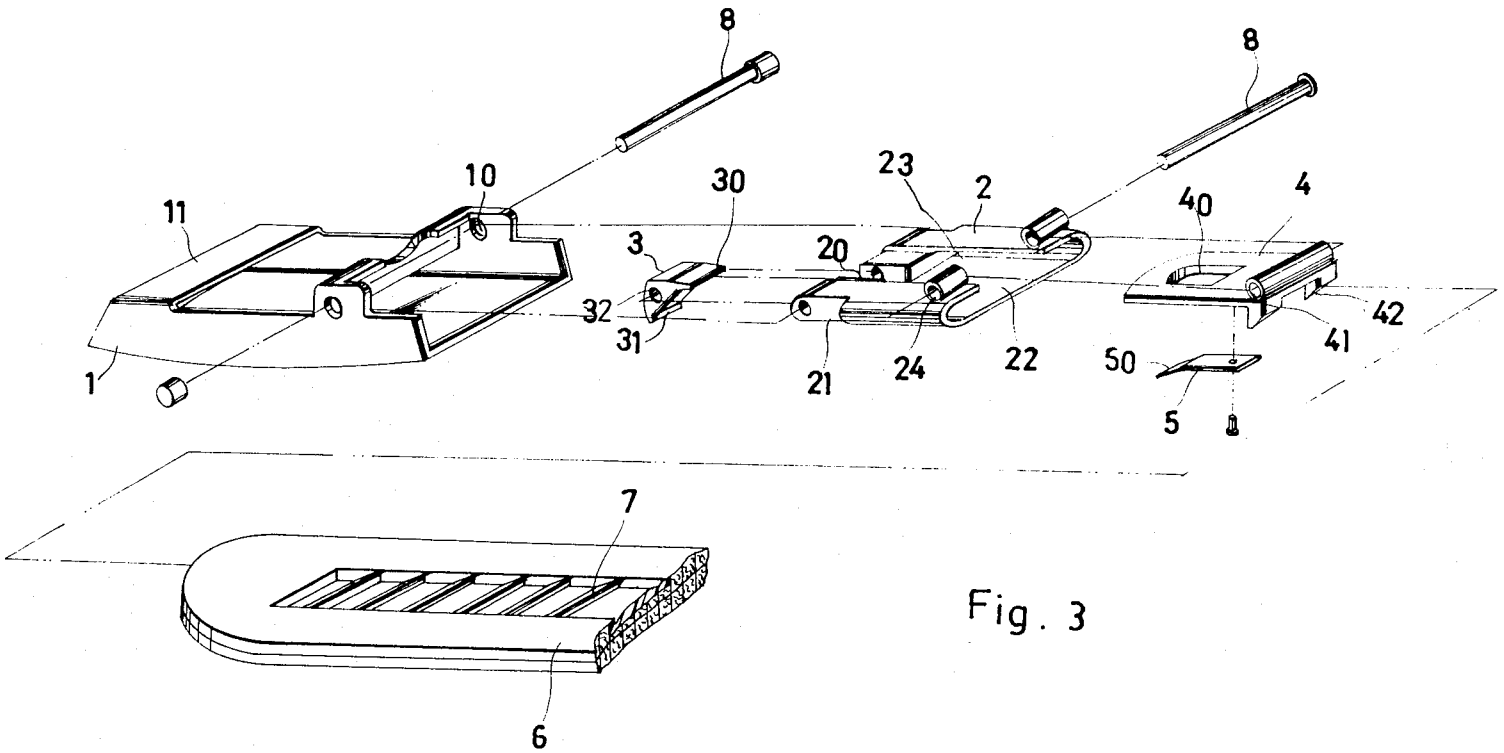
FIG. 3 is an exploded view of the improved belt buckle of this invention.
Figure 4:
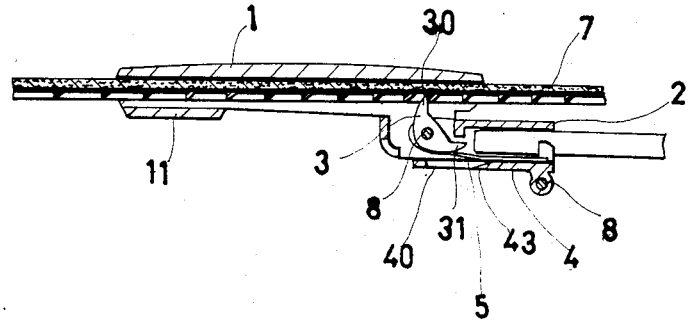
FIG. 4 is a longitudinal section of the improved buckle as shown in FIG. 3.

Referring now to the drawings, the nature of this invention is described and ascertained as follows:

As shown in FIG. 3, the improved belt buckle of this invention consists of a buckle body 1, a belt catch holder 2, a belt catch 3, a fastening plate 4, a spring plate 5, a belt 6, a serrate plate 7 and two knuckle pins 8. The buckle body 1 has two projections with eyes 10 on the rear parts of the side walls to form a knuckle joint with the corresponding projections of the catch holder 2, and bridge plate 11 on the front parts of the side walls. The belt catch holder 2 has a recess 20 in the middle of the front end, two projections 21 on the front end beside the recess 20, a belt catching slot 22 behind the recess 22 and projections, an open space 23, and two projections with eyes 24 on the rear parts. The fastening plate 4 has a square opening 40 in the front section, a projection with an eye 41 and two hooks 42 on the rear edge, and an inclination 43 (as shown in FIG. 4) at the rear edge of, and toward the square opening 40. The belt catch 3 has two ratchet corners 30, 31 and a knuckle joint eye 32.

Figure 5A:
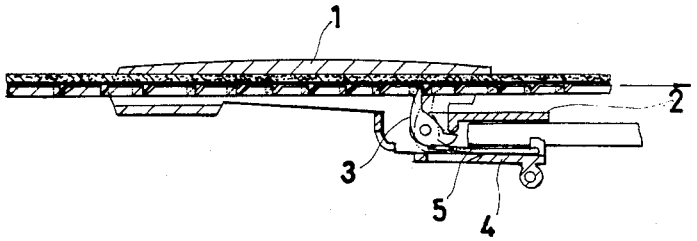
FIG. 5A illustrates the application of the improved belt buckle of this invention. (1)
Figure 5B:
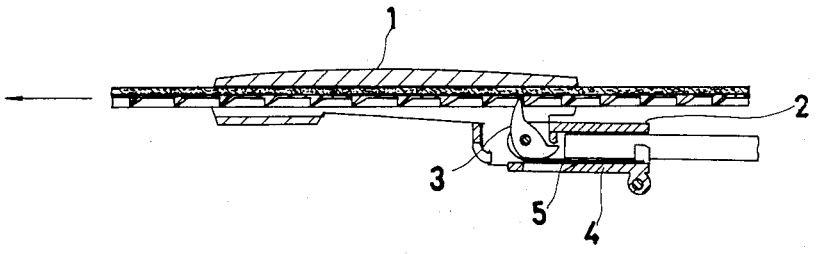
FIG. 5B illustrates the application of the said improved belt buckle. (2)
Figure 5C:
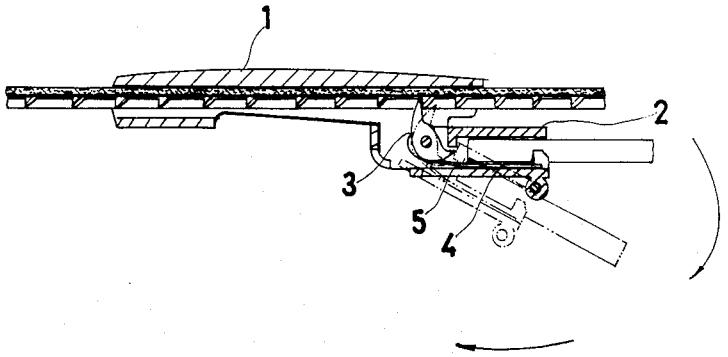
FIG. 5C illustrates the application of the said improved belt buckle. (3)

As shown in FIG. 4 the belt catch 3 is fitted in the recess 20 of the belt catch holder 2 and jointed together with holder 2 and body 1 by means of the knuckle eye 10 and pin 8 in such way that the belt catch 3 can swing to a limited extent and the ratchet corners 30, 31 can keep the belt from retreating. The fastening plate 4 is fitted in the open space 23 of the catch holder 2 and joined together with the holder 2 by means of the knuckle eyes 41, 24 and pin 8 in such way that the hooks 42 of the fastening plate 4 can fasten the belt end in the catching slot 22. With the upturned part 50 of the spring plate 55 engaging the upper ratchet corner 31 of the belt catch 3, the other ratchet corner 30 of the same stretches out retractably. The serrate plate 7 is mounted on the reverse of the belt 6. In application as shown in FIGS. 5A, 5B & 5C, when the belt is inserted in the space between two side walls of the body 1 the serrate plate 7 with its teeth inclined backward slides forward on the retractable ratchet corner 30 without being stopped and makes a light, regular tapping sound. When force is applied to pull the belt 6 out of the body 1, the retractable ratchet corner 30 of the belt catch 3 engages one of the ratches of the serrate plate 7 while the other ratchet corner 31 engages the front end of the belt catch holder 2 as shown in FIG. 5B. Thus the belt 6 is caught firmly without fear of loosening. To release, the belt catch holder 2 must be swingingly pushed off the body 1 as shown in FIG. 5C. Since the belt catch only taps the notches of the serrate plate, no damage will be caused to the obverse of the belt. The serrate plate can be made of wear-resistant metal or plastics. The belt can be fastened firmly without fear of slipping. The tightness of belt can be adjusted freely without the disadvantage of conventional belt buckle. So it is new and practical.

What is claimed is:

1. An improved belt buckle characterized by comprising:

(a) a buckle body having two projections with eyes on the rear of the two side walls, and a bridge plate on the front of the side walls;

(b) a belt catch holder having a recess in the middle of the front end, two projections on the front end beside the recess, a belt catching slot behind the recess, an open space and two projections with eyes on the rear parts;

(c) a fastening plate having a square opening in the front section, a projection with eye and two hooks at the rear and an inclination at the rear of and toward the square opening;

(d) a belt catch having two ratchet corners and a knuckle eye;

(e) a spring plate having an upturned part;

(f) a belt having a long recess in the reverse of one end for a serrate plate to mount on;

(g) a serrate plate having regularly arranged teeth like 90° triangles but with diagonals slightly curved; and (h) two pins;

wherein said belt catch being fitted in the recess of said belt catch holder and joined together with said belt catch holder and said buckle body by means of knuckles and pin in such way that said belt catch can swing to catch or release the belt; said fastening plate being fitted in the open space of said catch holder and joined together with the holder by means of knuckles and pin in such way that it can fasten the belt end firmly; said spring plate having its upturned part engaging one of the ratchet corners so that the other ratchet corner can move retractably; said serrate plate being mounted on the reverse of the belt and mating with the belt catch in fastening the belt adjustably.

* * * * *